United States Patent [19]

Taylor

[11] Patent Number: 4,934,955

[45] Date of Patent: Jun. 19, 1990

[54] ELECTRICAL CONNECTORS

[75] Inventor: John C. Taylor, Balladoole Arbory, Isle of Man

[73] Assignee: Strix Limited, Isle of Man

[21] Appl. No.: 350,000

[22] Filed: May 10, 1989

[30] Foreign Application Priority Data

May 13, 1988 [GB] United Kingdom ..... 8811380

[51] Int. Cl.[5] ..... H01R 13/00

[52] U.S. Cl. ..... 439/135; 439/376

[58] Field of Search ..... 439/374, 376, 135–142

[56] References Cited

U.S. PATENT DOCUMENTS

| | | | |
|---|---|---|---|
| 2,640,968 | 6/1953 | Lehr | 438/374 |
| 4,027,937 | 6/1977 | Norden | 439/376 |
| 4,072,387 | 2/1978 | Sochor | 439/374 |
| 4,350,401 | 9/1982 | Allen et al. | 439/374 |

FOREIGN PATENT DOCUMENTS

| | | |
|---|---|---|
| 2178910A | 2/1987 | United Kingdom . |
| 2192500A | 1/1988 | United Kingdom . |

*Primary Examiner*—Joseph H. McGlynn

*Attorney, Agent, or Firm*—Bacon & Thomas

[57] ABSTRACT

An electrical connector for a cordless appliance such as a water jug comprises a male pin part 70 mounted to the appliance and a female socket part 81 mounted to a base 90 for the appliance. The forward edge parts 100 of the socket side walls 94 engages with a shroud portion 91 of the male part 70, and the socket side walls 94 have recesses 95. This allows the lateral pivoting of the male part 70 with respect to the female part 81 while still providing for alignment of the terminal pins within the socket apertures 80. This facilitates engagement and disengagement of an appliance from its base without causing bending or stressing of the terminal pins.

8 Claims, 7 Drawing Sheets

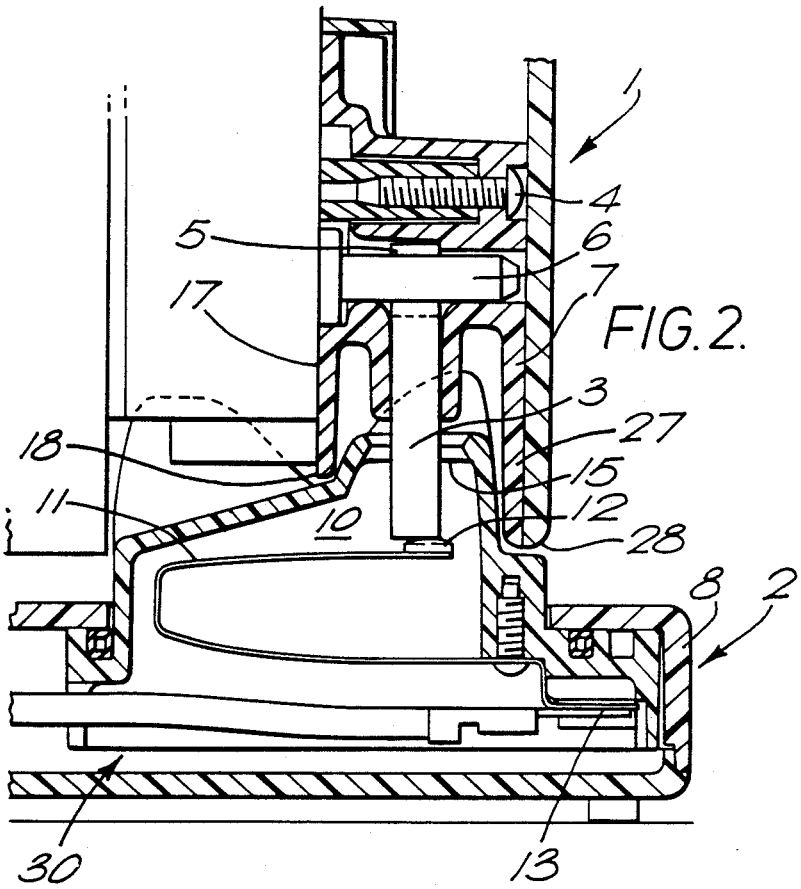
FIG. 2.
FIG. 3b.
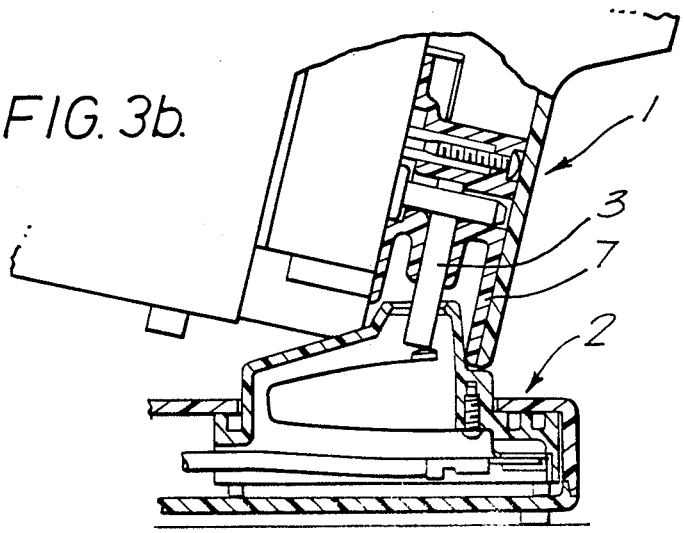

ELECTRICAL CONNECTORS

This invention relates to electrical connectors of the type used for "cordless" appliances i.e. appliances such as hot water jugs or irons to which electrical connection is made by locating the appliance on a base unit, the base unit being connected to the mains by a lead.

In general in such connectors, terminal pins are positioned on the underside of the appliance, connected, usually via switch means, to the heater of the appliance, and a socket connector is positioned in the base unit so as to be engagable with the plug as and when the appliance is placed on the base unit so that mains power can then be supplied to the appliance. Preferably a shroud surrounds the terminal pins, serving both to protect the pins and to guide them into the socket, the shroud having a cross-section corresponding substantially to that of at least an upper part of the socket connector and a length at least sufficient to cover the whole length of the pins. For a 10 amp connector the pins are typically only 1 to 3 mm thick and it is important that, at least in the lateral direction with respect to the pins, the plug is not guided into the socket connector by means of the pins which can easily be bent or twisted. In aligning the pins and socket, the shroud ensures that the pins enter their respective socket chambers vertically or very close to vertically.

Examples of such connectors are shown in our copending patent applications Ser. Nos. 8803883 and 8721070.

The natural line of movement when lifting, for example, a jug or an iron from a horizontal surface is to tilt the object onto one edge then lift it along an arc or a diagonal inclined to the horizontal surface at an angle considerably less than 90°. Also, where the appliance is plugged into a socket, disengagement would be assisted by using such a tilting movement and also by rocking the appliance from side to side. However in connectors of the type described above where the appliance is engaged with a base unit, owing to the close fit engagement of the shroud with the socket connector, in order to detach the appliance from the base unit it is necessary to lift the appliance substantially vertically at least until the pins are clear of the socket chambers. The generally long overlap of the shroud and the socket and their very close fit thus inhibits any non-vertical and rocking movements. The effect of this is that there is a tendency for the base unit to be picked up with the appliance. It is also awkward for the user to follow a true vertical line, particularly if the appliance is heavy or unevenly weighted, or if the lifting action is made hurriedly. If the base unit is picked up unwittingly along with the, say, jug, there is a danger that by jarring the mains lead hot water will be spilled or the base unit will be unsafely disconnected. Of course the base may be picked up wittingly with the jug or held down by hand to prevent it being picked up, but the convenience of the "cordless" arrangement is then lost.

According to one aspect of the invention an electrical connector comprises a male terminal pin connector adapted for engagement with a female socket connector by insertion of each pin into a socket chamber via respective apertures formed in the forward end of the socket connector, wherein the relative dimensions of the said pins and socket chamber(s) allow the free end of each pin some freedom of movement within the socket chamber, the terminal pin connector including a guide means which cooperates with the socket connector to provide alignment between the pins and respective socket openings at least in the lateral direction with respect to the pins, wherein the lateral walls of the socket connector are a close fit within the guide means only in the region of their forward edges so as to permit limited pivotal movement of the pins with respect to the socket connector whilst maintaining said lateral alignment between the pins and apertures at the forward end of the connecter.

Thus, whilst alignment and guidance of the pins, at least in the lateral direction, is provided by the guide means adjacent the forward end of the socket connector, thereby avoiding distortion or bending of the pins, limited pivotal movement of the pin connector with respect to the socket connector is accommodated. In the context of a cordless appliance, this enables the user to pivot the appliance with respect to the base unit to a limited extent before or during disengagement of the pin and socket connectors as the appliance is removed from the base unit. Such limited pivotal movement is effective to release more readily the base unit from the appliance, and also enables the user to follow a more natural line of movement of the appliance away from the base unit, thereby avoiding the drawbacks of the prior art arrangements discussed above.

Preferably, limited pivotal movement of the pin connector is also permitted in the longitudinal direction with respect to the pins, i.e. in a direction parallel to the planes in which the pins lie. In the longitudinal direction, it is however generally less critical for guide means to maintain the pins in accurate alignment with respect to the socket openings since the pins are less vulnerable to bending in their longitudinal planes, and, moreover, in the longitudinal direction the socket openings can be substantially longer than the breadth of the respective pins. An appropriate clearance between the guide means and socket connector along the entire length of the socket connecter can therefore be provided, without the need for the guide means closely to embrace the socket connector at its forward end. It will be understood that a similar increase in the size of the socket openings with respect to the pin thickness could not be provided in the lateral direction without undesirably increasing the ease of access e.g. by a child with a sharp implement to the live parts of the socket connecter.

The guide means is preferably a shroud forming part of the male connector and at least partly surrounding the terminal pins, the shroud defining a recess within which the female connector may be matingly engaged.

In the longitudinal direction with respect to the pins, the shroud may be formed with at least one edge cut away relative to the other edges, thereby to increase the clearance with respect to the socket connector to accommodate pivotal movement in the longitudinal direction, the socket connector being shaped correspondingly to mate with the shroud edge. The longitudinal side walls of the socket connector are preferably recessed in the lateral direction with respect to a forward end part thereof, so that the shroud closely embraces the forward end part to maintain lateral alignment of the pins with the socket apertures, whilst a clearance is defined between the shroud and the side walls rearwardly of the forward end part to permit limited relative pivotal movement in the lateral plane as aforesaid.

Means may be provided in the socket connector close to the apertures thereof so as to prevent access to and entry of water to the live parts of connector when the male connector is removed from the socket. This is of particular importance in cordless appliances such as water jugs where water could be accidentally spilt on the socket. Conveniently this means can be a shutter member or members which may be spring mounted so as to be movable out of the apertures when the male connector pins are introduced and to move back into the aperture when the pins are removed.

It will be appreciated that when mounted to the base unit of a cordless appliance, the socket apertures of the socket connector will generally be upwardly facing so that the "forward" end thereof as referred to above is the uppermost end.

The invention extends to a cordless electrical appliance and base unit therefor respectively incorporating pin and socket connectors as aforesaid.

Preferred embodiments of the invention will now be described, by way of example only, with reference to the following drawings, of which:

FIG. 2 is an enlarged sectional view of the connector shown in FIG. 1.

Figure 1:
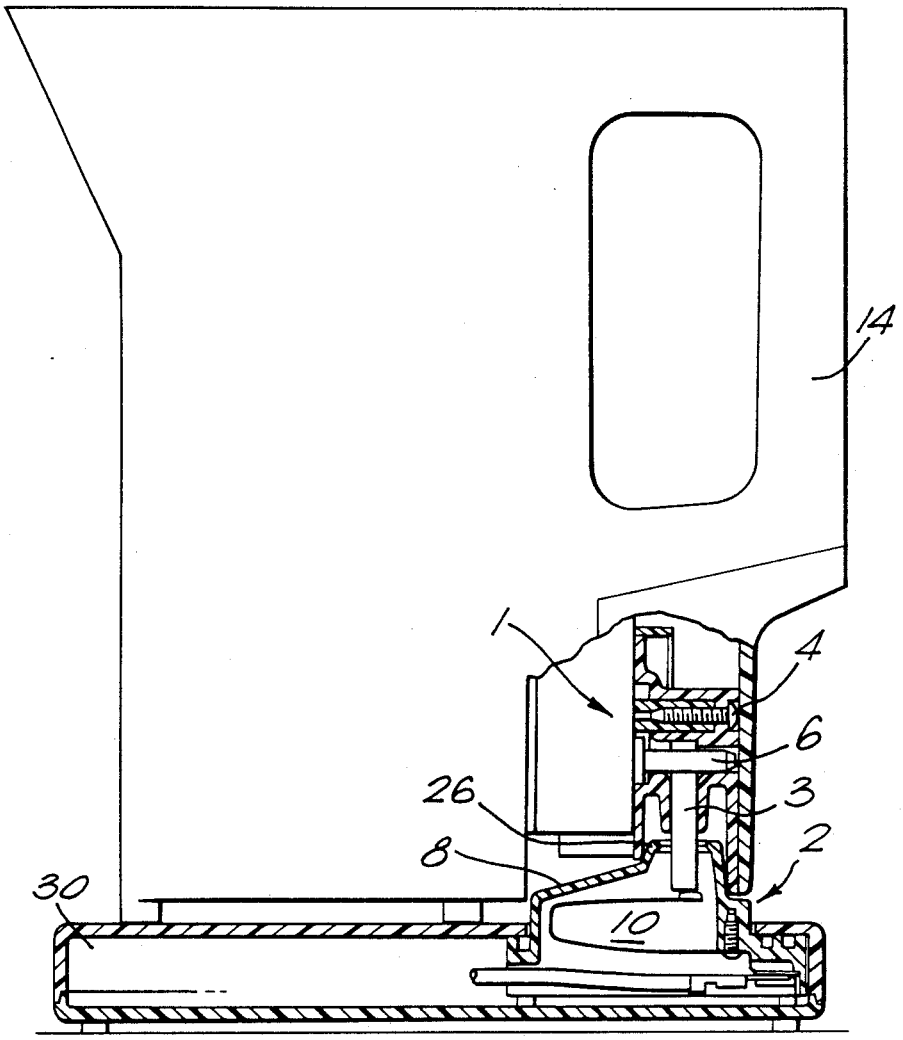
FIG. 1 is a sectional view of an appliance in the form of a jug incorporating a male pin connector and a female socket connector in accordance with a first embodiment of the invention.
Figure 3A:
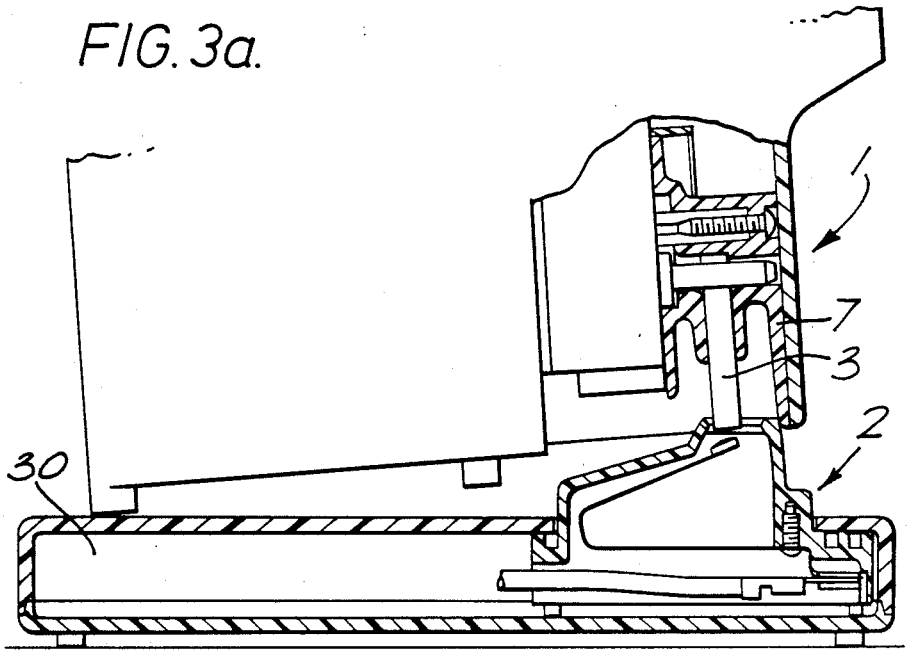
Figure 4:
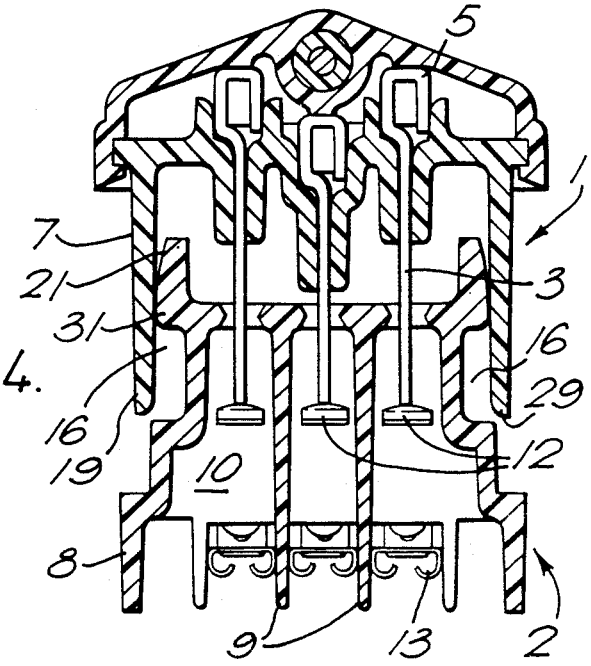
Figure 5:
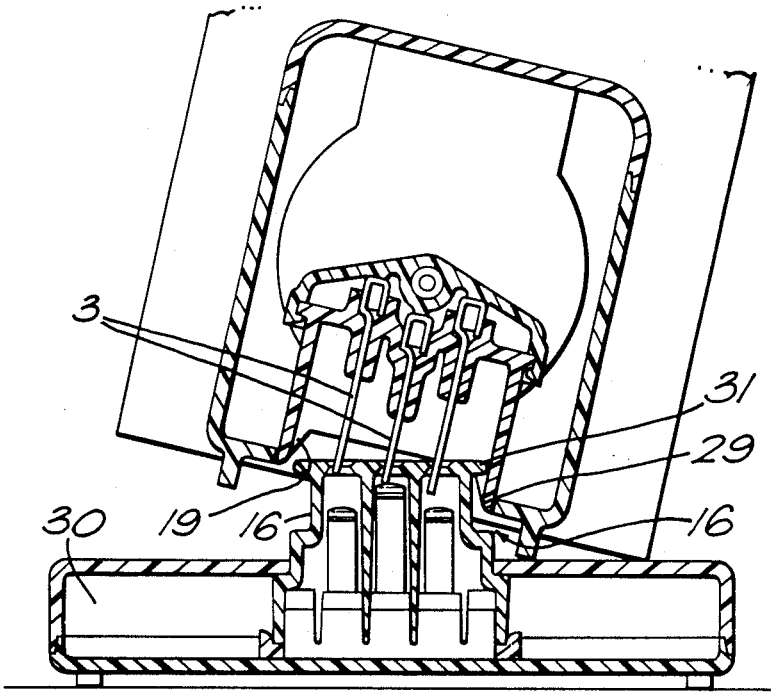
Figure 6:
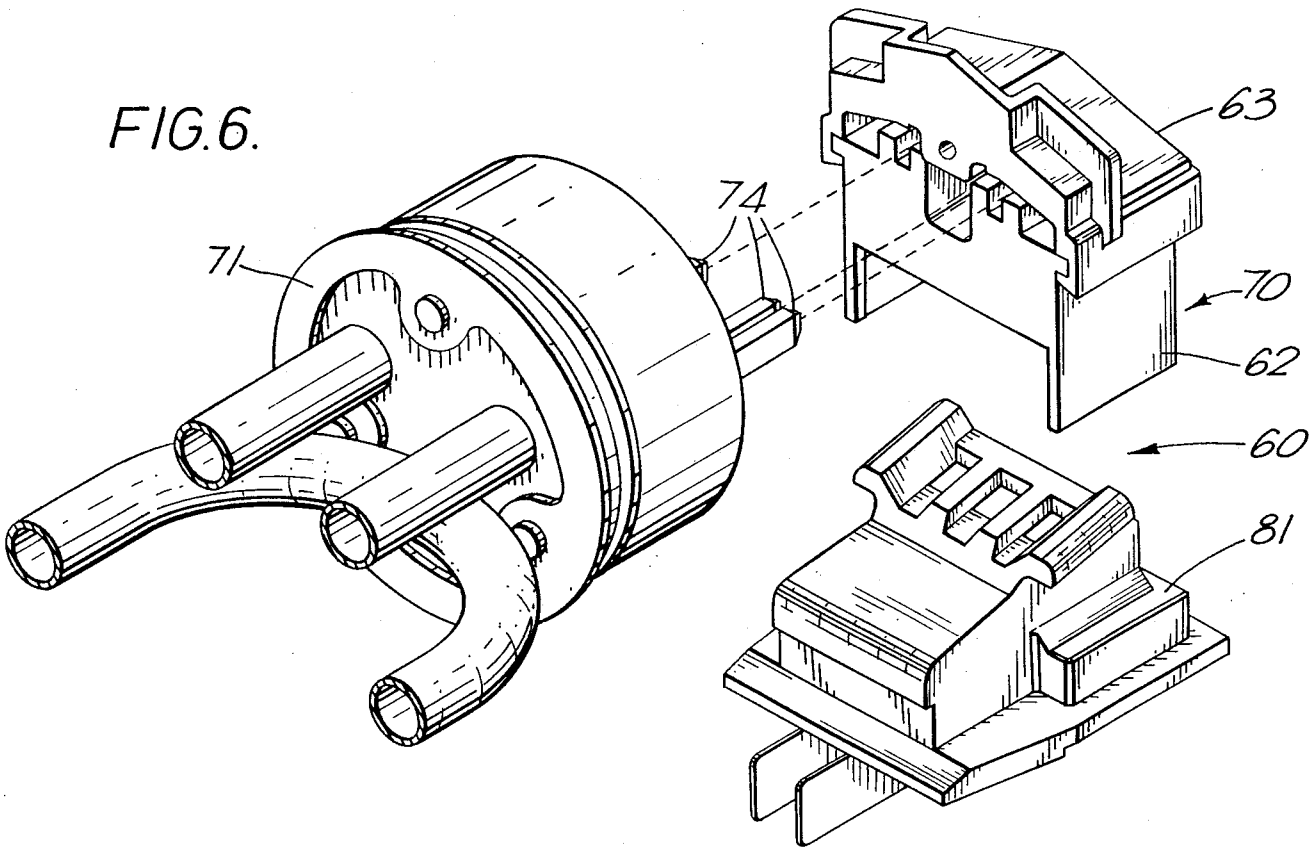
Figure 7:
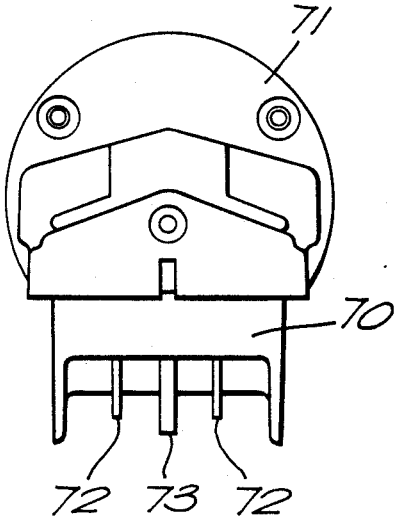
Figure 9:
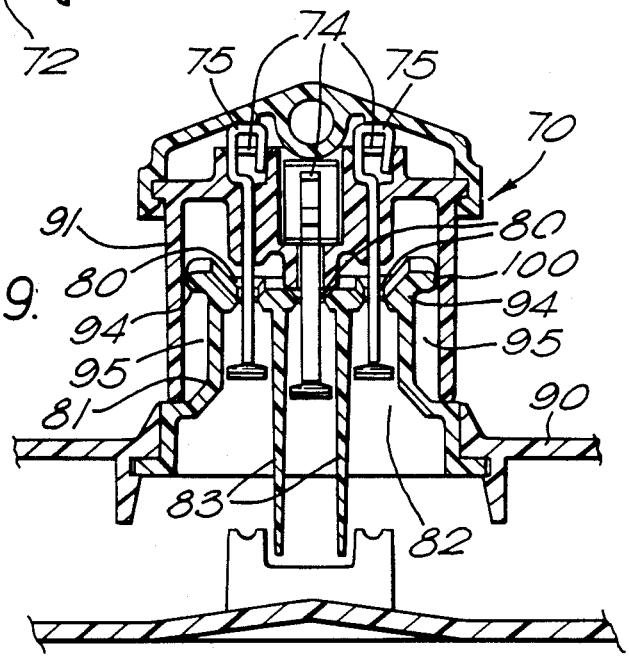
Figure 8A:
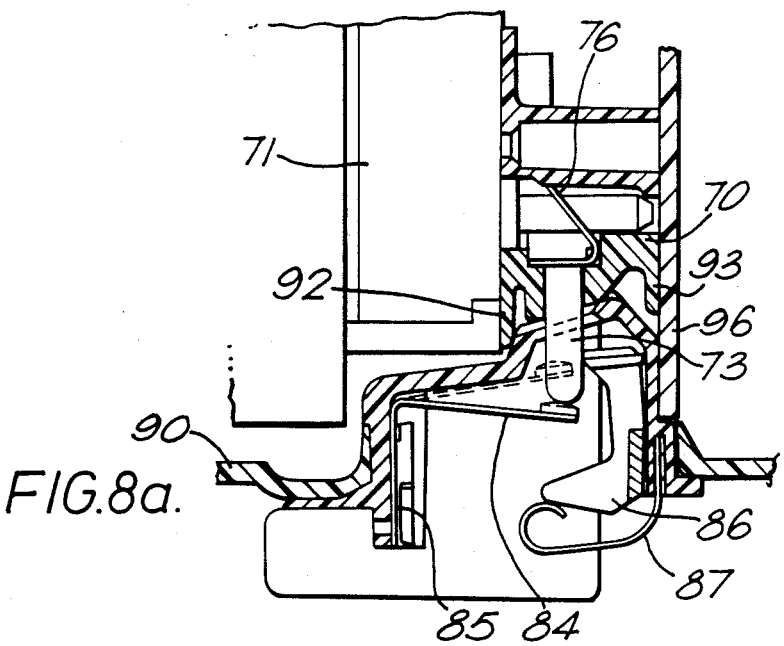
Figure 8B:
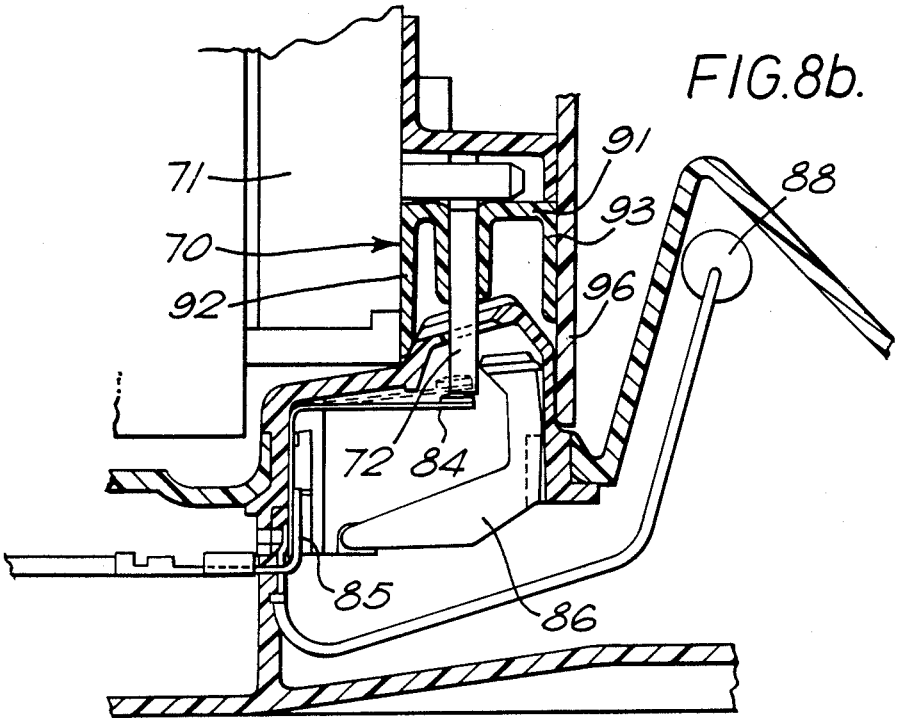

FIGS. 3*a* and 3*b* show the available longitudinal pivotal movement of the jug;

FIG. 4 is a section through the connector along the line II—II of FIG. 1; and FIG. 5 shows the available lateral pivotal movement of the jug;

FIG. 6 shows a schematic, exploded view of a male connector for mounting on a thermal control of a water jug, with a female socket connector;

FIG. 7 shows the male pin connector of FIG. 6 mounted on a control unit of an appliance;

FIGS. 8*a* and 8*b* show vertical sectional views of the connector of FIG. 7, mounted on an appliance and engaging a socket member in a base and taken through the earth contact and another contact respectively; and FIG. 9 shows a vertical section through the embodiment of FIG. 7 taken along the common line of the contacts.

Referring to FIGS. 1 and 2, a first connector in accordance with the invention comprises a male pin connector 1 and a female socket connector 2. The male connector, when the appliance is assembled, is attached to the base of the appliance—a cordless hot water jug, for example—by means of a fixing screw 4. The socket connector forms part of a base unit 30 for the appliance. The handle 14 of the jug extends generally vertically adjacent the side of the jug—defined as the rear side—in line with the connector. Three terminal pins 3 (one shown) extend vertically downwards and are surrounded by a rigid plastic shroud 7. The terminal pins are provided with sleeves 5 for engagement over horizontally disposed terminal pins 6 forming part of a thermally-sensitive control unit of the jug whereby the pins 3 are electrically connected via switch means of the control unit to the heater of the jug.

The female socket connector 2 consists of a housing 8 enclosing three chambers 10 formed by dividing walls 9 (see FIG. 4). Within each chamber 10 is a leaf spring contact 11 provided at its free end with a contact member 12 for engagement with a respective terminal pin 3 on the male connectors 1. The ends of the contacts 11 remote from the contact members 12 are provided with terminals 13 whereby the contacts 11 may be readily connected to a cable for the supply of mains power to the connecter.

As can be seen more clearly in FIG. 2, to allow pivotal movement of the pin connector 1 in a longitudinal direction with respect to the pins, i.e. in a plane parallel to the planes of the pins, the slots 15 by which the pins enter the socket chambers 10 are made substantially longer than the pins are broad. The play provided for the free ends of the pins in the socket chambers enables the male connector 1 to be rocked backwards and forwards, pivoting about the lower front edge 18 or rear edge 28 and to be removed from the female connecter 2 by pivoting and lifting backwards the appliance. This is a natural line of movement, so the jug is comfortable to use. Moreover, such rocking movement assists in detaching the base unit from the appliance. Similarly on reconnection of the jug to the base, a natural arcuate movement can be used.

FIG. 3*a* shows how the jug may be tilted towards its front edge on the point of connection or disconnection. FIG. 3*b* shows the extent of rearward pivoting available and illustrates how the shroud 7 assists in guiding the male connector safely into the socket connector, protecting the pins 3 from stress.

In the longitudinal plane, sufficient clearance is provided between the shroud and the sidewalls of the socket connector to accommodate the limited pivotal movement as illustrated. Conventionally the shroud of known connectors is of uniform length and fully surrounds the pins. However, in the illustrated preferred embodiment, in order to increase the permitted degree of pivoting in the rearward direction as shown in FIG. 3*b* the two longitudinally opposite sides 17, 27 of the shroud are made of unequal length so when the shroud is pivoted about the lower edge 28 the other edge 18 clears the socket connector. In order to seal the gap beneath the short side 17, the socket connector housing 8 is formed with a raised portion 26.

The arrangement shown whereby the longer side 27 is the rear (i.e. outermost) side is preferable because the longer overlap of the shroud over the socket connecter when the appliance is connected makes access to the pins more difficult.

In the lateral direction, close guidance is needed because the slots are necessarily narrow to limit access to the terminals. There is also more risk of the pins being bent in this direction if they catch the edges of the socket apertures. The illustrated arrangement provides close guidance while allowing for relative pivotal movement in the lateral plane i.e. the vertical plane perpendicular to the plane in which the primary natural lifting arc lies. Referring to FIG. 4, the sidewalls of the socket connector 2 are formed with recesses 16 on each side at a position so that when the male connector 1 is attached (as shown) the lower side edges 19, 29 of the shroud lie over the recesses and are thus spaced from the sidewalls of the socket connector. The male connector can therefore be tilted in the plane of the figure with respect to the female connecter, as shown in FIG. 5. However, since the shroud closely embraces the forward end part 31 of the socket connecter lateral alignment between the pins and the socket openings is accurately maintained in the horizontal plane of such openings during engagement and disengagement, regardless of any lateral pivoting as shown in FIG. 5, so that bending or distortion of the pins is avoided. Thus, the arrangement allows for pivoting in the lateral direction as the appliance is lifted and replaced, while still preventing use of the pins for guidance. Some freedom of movement for the pins is provided by making the slots 15 slightly wider than the thickness of the pins. However, the guidance provided by the shroud is such that the width of the slots can be less than that which would render the socket unsafe owing to ease of access to the live terminals. In this respect, the presently accepted standard maximum width is 2.6 mm.

Thus, it will be seen that in accordance with the invention the user may also follow a more natural movement of engagement and disengagement, and assist detachment of the base unit from the plug by a rocking movement in the lateral direction.

A wall 21 projecting upwardly from the forward part 31 is preferably curved to provide a smooth path for the lower edge of the shroud as it engages over the socket connecter. It may also curve down and forwards in the longitudinal plane (not visible in the drawings), to provide a smooth path for the lower front edge of the shroud as it pivots backwards.

With reference now to FIG. 6, this shows an exploded schematic view of a second connector 60 embodying the invention and shows how the male connector 70 which comprises a lower member 62 and a cover member 63 may be adapted for assembly on the pins 64 of a control unit 71 of a hot water jug. The female connector socket 81 will be mounted in use in a suitable manner on a base (not shown).

FIG. 7 shows the male connector 70 mounted on the control unit 71 of an appliance while FIGS. 8*a*, 8*b* and 9 show the connector in more detail. The male connector 70 is connected to a control unit 71 of an appliance with the terminal pins 72,73 of the male connector engaging pins 74 of the control unit 71. In this embodiment however, while the live and neutral pins 72 engage the control unit pins via sleeves 75, the earth pin 73 is connected to the corresponding control unit pin 74 via a conductive clip 76. As in the first embodiment, the terminal pins extend downwardly through apertures 80 in the socket housing 81 into respective chambers 82 separated by walls 83. The socket housing 81 is mounted in a base member 90.

It will be noted that the layout of the electrical contacts is different from that in the first embodiment with the spring contacts 84 extending forwardly from the pins and ending in terminals 85. This facilitates the provision of a pivotally mounted shutter 86 which is biased by a spring 87 to close the apertures 80 when the pins are removed from the socket. It is pushed out of the way by the pins when they are introduced into the apertures. This prevents accidental entry of water into the live parts of the socket 81 when the jug is removed from its base.

A neon bulb, 88 is provided in the electrical supply circuit such that when the terminal pins engage the contacts 84 to power the appliance, the bulb 88 lights.

As in the first embodiment, the terminal pins are at least partially surrounded by a plastic shroud member 91. In this case, however, the shroud 91 is cut away at both the front and the back to give a shortened front wall 92 and a shortened back wall 93. The back cover 96 of the appliance extends beyond the end of the back wall 93 when the connector is assembled to the appliance, as can be seen from FIGS. 8*a* and 8*b*. This allows a more compact arrangement than the first embodiment where both the rear wall of the shroud and the appliance back engage over the socket, but still allows the same longitudinal pivoting.

As in the earlier embodiment, the shroud 91 closely embraces the forward end portion of the side walls 94 of the socket housing 81. Again the socket 81 has recesses 95 in its side walls 94 so that the lower side parts of the shroud are spaced from the socket so as to allow pivoting in a lateral plane while the terminal pins are still being guided in the apertures 80.

Thus the invention provides in its preferred embodiment a connector which facilitates the engagement and disengagement of an appliance from a base by allowing lateral pivotal movement of a male pin connector with respect to a female socket member while still maintaining lateral alignment between the pins and the socket apertures. Furthermore the particularly preferred arrangements of the connector disclosed facilitate the adaptation of existing control unit designs, i.e. those not adapted for "cordless" arrangements, by the simple engagement of the pins of the connector with horizontal pins of a control unit of the appliance.

The preferred embodiments of the invention have been described in the context of an upright appliance having a handle extending vertically on a line with the connector. The invention is however equally applicable to appliances on which the relative positions of the handle and the connector are different. The handle may, for example, be opposite the connecter, or it may be horizontal, spanning the top of the appliance. Moreover, in an alternative configuration of cordless appliance, the pins of the terminal pin connector may be offset with respect to the vertical, with the socket connector correspondingly inclined.

Although the appliance referred to in the preferred embodiments is a water jug, the invention is of course applicable to other cordless appliances such as for example irons.

I claim:

1. An electrical connector comprising male terminal pin connecter adapted for engagement with a female socket connector by insertion of each pin into a socket chamber via respective apertures formed in the forward end of the socket connector, wherein the relative dimensions of the said pins and socket chamber(s) allow the free end of each pin some freedom of movement within the socket chamber, the terminal pin connector including a guide means which cooperates with the socket connector to provide alignment between the pins and respective socket openings at least in the lateral direction with respect to the pins, wherein the lateral walls of the socket connector are a close fit within the guide means only in the region of their forward edges so as to permit limited pivotal movement of the pins with respect to the socket connector whilst maintaining said lateral alignment between the pins and apertures at the forward end of the connecter.

2. An electrical connector according to claim 1 wherein limited pivotal movement of the pin connector is also permitted in the longitudinal direction with respect to the pins.

3. An electrical connector according to claim 1 wherein said guide means is a shroud forming part of the male connector and at least partly surrounding the terminal pins, and defining a recess within which the female connector may be matingly engaged.

4. An electrical connector according to claim 3 wherein said shroud is, in the longitudinal direction with respect to the pins, formed with at least one edge cut away relative to the other edges.

5. An electrical connector according to claim 1 wherein the lateral side walls of the socket connector are recessed with respect to a forward end part thereof.

6. An electrical connector according to claim 1 wherein said socket has means to close said apertures when said pins are removed therefrom.

7. In combination a cordless electrical appliance and a base unit therefor, said base unit and appliance having an electrical connector as claimed in any preceding claim, said male terminal pin connector being provided on said appliance and said female socket connector being provided on said base unit.

8. A combination as claimed in claim 7 wherein said terminal pins are generally vertical and are connected to generally horizontally disposed terminal pins of a thermally sensitive control unit of the appliance.

* * * * *